US005755514A

United States Patent [19]

Baar-Bartelt

[11] Patent Number: 5,755,514

[45] Date of Patent: May 26, 1998

[54] BAG FOR PACKING MOISTURE-SENSITIVE MATERIALS

[75] Inventor: Reinhold Baar-Bartelt, Wipperfürth, Germany

[73] Assignee: Nord-West Verpackung Karl Gotze GmbH & Co., Germany

[21] Appl. No.: 612,971

[22] PCT Filed: Oct. 14, 1994

[86] PCT No.: PCT/DE94/01225

§ 371 Date: Jul. 22, 1996

§ 102(e) Date: Jul. 22, 1996

[87] PCT Pub. No.: WO95/11169

PCT Pub. Date: Apr. 27, 1995

[30] Foreign Application Priority Data

Oct. 16, 1993 [DE] Germany ..... 93 15 795.9

[51] Int. Cl.[6] ..... B65D 30/16; B65D 30/18

[52] U.S. Cl. ..... 383/104; 383/120; 383/125

[58] Field of Search ..... 383/104, 120, 383/121, 125, 126

[56] References Cited

U.S. PATENT DOCUMENTS

| | | | |
|---|---|---|---|
| 2,996,238 | 8/1961 | Linde | 383/126 X |
| 3,485,438 | 12/1969 | McCall et al. | 383/126 X |
| 3,519,195 | 7/1970 | Kuhnle | 383/126 |
| 4,808,421 | 2/1989 | Mendenhall et al. | 383/125 X |

*Primary Examiner*—Jes F. Pascua
*Attorney, Agent, or Firm*—Vickers, Daniels & Young

[57] ABSTRACT

A bag, particularly for packing humidity-sensitive substances, is entirely made of a liquid-type and vapor-type plastic sheet or of a composite plastic foil of at least 50μ and at most 300μ thick. The bag is glued along it longitudinal seam. The bag made of such thick plastic sheets may be produced and processed in the same way as paperbags in a bag-making machine.

15 Claims, 2 Drawing Sheets

BAG FOR PACKING MOISTURE-SENSITIVE MATERIALS

TECHNICAL FIELD

This invention relates to a bag, and more particularly to a bag for packing moisture-sensitive materials, having a front wall and a back wall, and having sidewalls which form longitudinal outer edges with the front wall and the back wall.

BACKGROUND OF THE INVESTIGATION

Bags of this type, which are used for packing building materials or washing powders for example, generally consist of thick paper or of cardboard in order to ensure their dimensional stability and to ensure that they can be stacked. In order to prevent the ingress of moisture the bags are provided with a water-tight or vapour-tight layer, which may consist of a plastic coating or a coat of lacquer and which is bonded to the paper bag in a suitable manner.

Packages comprising composite materials such as these are not only expensive to manufacture but are also difficult to dispose of in a manner which takes due account of the environment, since the different materials of the bag have to be separated from each other before they can be appropriately re-utilised.

SUMMARY OF THE INVENTION

The object of this invention is to construct a dimensionally stable, moisture-repellent bag in such a way that it can be manufactured simply and inexpensively, and can easily be disposed of and re-utilised.

This object is achieved by means of the invention in that the bag completely consists of a liquid- and vapour-tight plastic film which has a thickness of at least 50 μm and at most 300 μm, and that the longitudinal seam of the bag is not welded, but is adhesively bonded.

This form of construction has the advantage that re-utilisation of the plastic of the bag can be effected directly after use. The use of a plastic film more than 50 μm thick enables the bag to be manufactured and folded by machine. The adhesive bonding of the longitudinal seam prevents the shrinkages which occur during welding, which is otherwise customary, so that the bag has a high degree of dimensional accuracy and stability.

The bag is advantageously a block-base bag having at least four transverse outer edges on one end face, along which edges parts of the front wall, the back wall and the sidewalls are folded over in order to form a block base. Block-base bags of this type can be stacked particularly easily and safely.

The bag may also be a bag with side folds, which can be manufactured particularly simply and inexpensively.

The plastic film is preferably a polyethylene film of high density (HDPE) which has a thickness of about 100 μm. A thick HDPE film of this type is particularly tear-resistant and enables the edges of the bag to be folded easily. It is also possible to use a plastic composite film comprising a polyethylene film of high density (HDPE) and a polyethylene film of low density (LDPE), which are both classed as polyolefines, and the chemical composition of which is similar so that their combined re-utilisation is possible without problems.

It is advantageous if the bag is also adhesively bonded at overlapping portions of the film in its base region. By this means, shrinkages due to welding are also reliably prevented at the base of the block-base bag or at the closed end of the bag with side folds.

The block base of the block-base bag is advantageously provided with a covering of plastic film which approximately corresponds to the dimensions of the block base and is adhesively bonded to the base from the outside. By this means additional stiffness is imparted to the block-base bag, and it has a homogeneous surface on its bottom face, which can easily be printed on.

It is particularly advantageous if the base of the block-base bag is adhesively bonded by means of two mutually parallel beads of adhesive which have a length which at least corresponds to the width of a longitudinal side, and if the covering is adhesively bonded all over to the base. By this means the flaps of the block base can be adhesively bonded to each other with just a little adhesive. The all-over adhesive bonding of the covering to the base ensures a particularly good seal.

The adhesive is preferably a hot-melt adhesive, which can be processed particularly easily, which ensures a high degree of stability of the adhesive seams, and which seals the seams particularly well, especially in the region of the base, due to its large volume.

In summary, there is provided a bag, particularly for packing moisture-sensitive materials, having a front wall and a back wall, and having sidewalls which form longitudinal outer edges with the front wall and the back wall. The bag completely preferably consists of a liquid and vapor-tight plastic film which has a thickness of at least 50 μm and at most 300 μm. The bag is preferably not welded at its longitudinal seam, but is adhesively bonded. The bag is also preferably a block-base bag having at least four transverse outer edges on one end face, along which edges parts of the front wall, the back wall and the sidewalls are folded over in order to form a block base. The bag also preferably includes side folds. The plastic film is preferably a high-density polyethylene (HDPE) film with a thickness of 100 μm. The mutually overlapping parts in the base region of the bag are preferably adhesively bonded to each other. The base of the block-base bag is preferably provided with a covering of plastic film which approximately corresponds to the dimensions of the block base and is adhesively bonded to the base from the outside. The overlapping parts of the base of the block-base bag are preferably adhesively bonded by means of two mutually parallel beads of adhesive which have a length which at least corresponds to the width of a longitudinal side. The covering is preferably adhesively bonded over the complete base. The mutually overlapping parts of the base are also preferably adhesively bonded all over to each other. The adhesive is preferably a hot-melt adhesive.

These and other advantages will become apparent to those skilled in the art upon reading the following description taken together with the accompanied drawings.

BRIEF DESCRIPTION OF THE DRAWINGS

Reference may now be made to the drawings, which illustrate various embodiments that the invention may take in physical form and in certain parts and arrangements of parts wherein.

DETAILED DESCRIPTION OF THE PREFERRED EMBODIMENT

Figure 1:
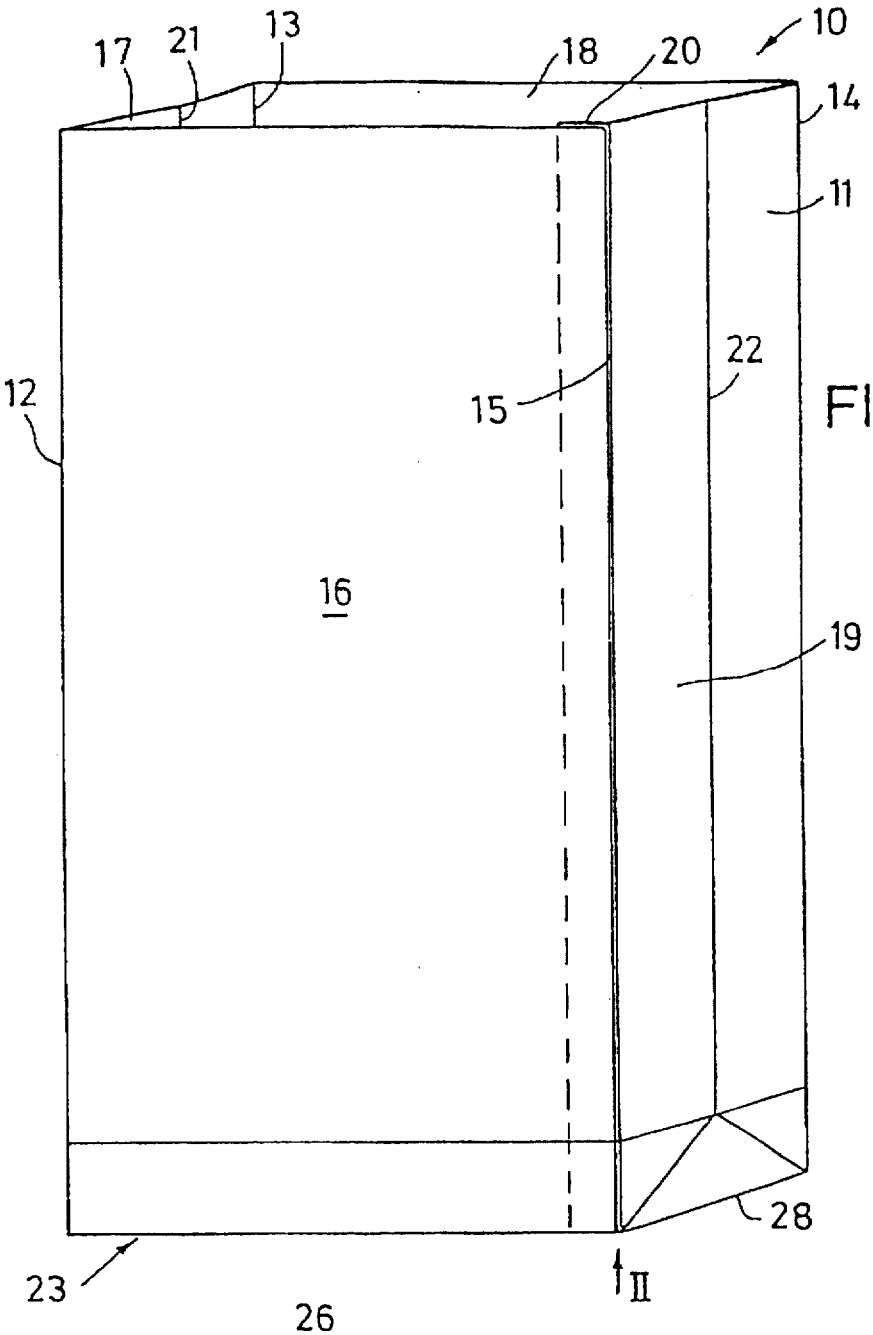
FIG. 1 is a perspective illustration of a block-base bag according to the invention which is open at the top.

Referring now to the drawings, wherein the showings are for the purpose of illustrating the preferred embodiments of the invention only and not for the purpose of limiting the same, FIG. 1 illustrates a block-base bag is denoted by 10. This bag is employed for packing moisture-sensitive bulk materials, such as plaster, washing powder or the like, and completely consists of a liquid- and vapour-tight plastic film 11. This plastic film 11 is a polyethylene film (HDPE film) of high density, the thickness d of which is at least 50 μm. In the embodiment illustrated, the plastic film 11 has a thickness of 100 μm. The block-base bag 10 illustrated is manufactured on a block-base bag machine, like a paper bag. It has four parallel longitudinal outer edges 12, 13, 14, 15, at which the longitudinal sides 16, 17, 18 and 19 adjoin each other. The narrow longitudinal side 19 has a projecting strip 20 on its longitudinal outer edge 15, which strip is adhesively bonded to the free outer border of the front longitudinal side 16, so that an approximately rectangular tube is produced as is known in the art for block-base bags. In addition, each of the narrow longitudinal sides 17 and 19 has an internal fold 21 and 22, respectively, running parallel to the longitudinal outer edges 12 and 13 and 14 and 15, respectively, which folds subdivide the narrow longitudinal sides into two halves and which lie on top of each other when the bag is placed with its front and back longitudinal sides 16 and 18 lying flat on top of each other for packing purposes.

Figure 2:
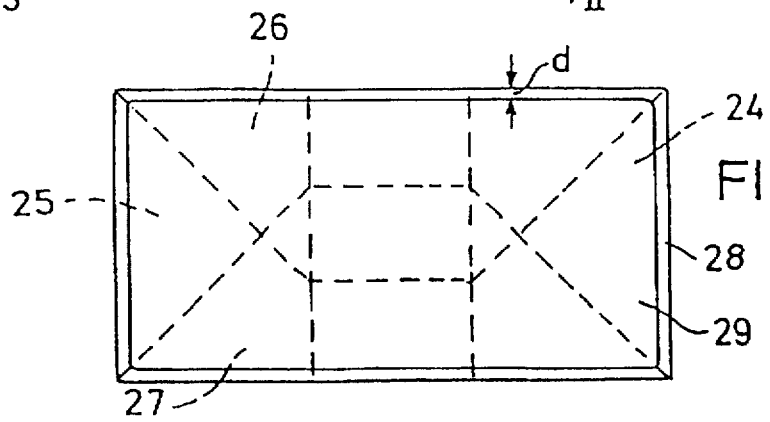
FIG. 2 is a plan view of the block-base bag shown in FIG. 1.
Figure 3:
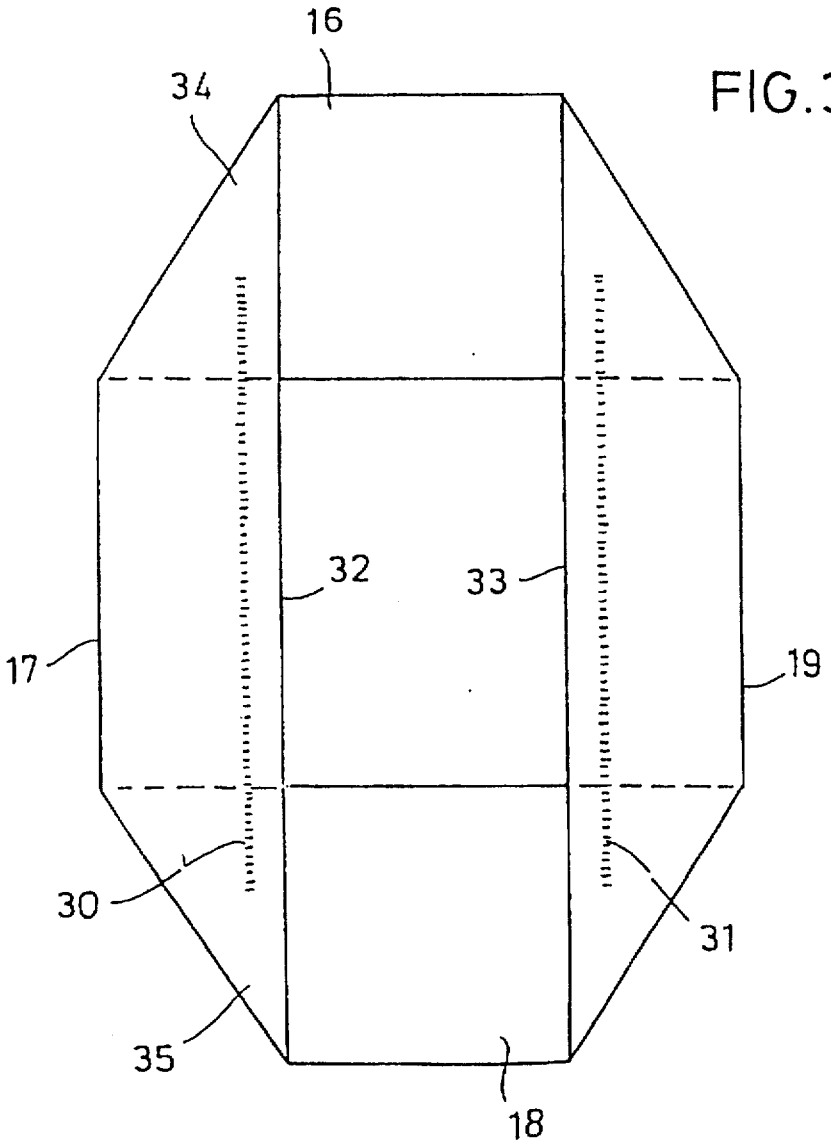
FIG. 3 is a plan view of the base of the block-base bag, in its unfolded state.

As is customary for block-base bags, the narrow longitudinal sides 17 and 19 and the wide front and back longitudinal sides 16 and 18 are folded inwards in pairs and bent over inwards at right angles at the bottom end 23 of the bag, so that the fold structure illustrated by the dashed lines in FIG. 2 is formed, as is customary for block-base bags. The mutually overlapping parts 24, 25, 26, and 27 which form the base of the bag are preferably adhesively bonded by means of two mutually parallel beads 30, 31 of adhesive, which run near the bottom edges 32, 33 of the narrow longitudinal sides 17, 19 and parallel thereto, and which extend as far as the triangular base flaps 34, 35 (FIG. 3).

To prevent the packed material, for example washing powder, flour or plaster, from penetrating between the folds of the inwardly folded parts of the base, the mutually overlapping parts of the base may also be adhesively bonded all over to each other. The covering creates a smooth surface, which can be printed all over and which can also be provided with a handle or the like.

In order to close it, the filled bag may be adhesively bonded at its top edge, but may also be welded or sewn. It can thereby be used universally and may be employed on all the customary bagging installations for pourable or flowable materials to be packed.

The invention is not restricted to the embodiment described above, but may also be used for bags with side folds, the front and back walls of which are sealed to each with the inclusion of the inwardly folded sidewalls.

The invention has been described with reference to a preferred embodiment and alternates thereof. It is believed that many modifications and alterations to the embodiment disclosed will readily suggest themselves to those skilled in the art upon reading and understanding the detailed description of the invention. It is intended to include all such modifications and alterations insofar as they come within the scope of the invention.

I claim:

1. A block-base bag consisting of plastic film and an adhesive for packing moisture-sensitive materials, said bag having a front wall, a rear wall, sidewalls which form longitudinal outer edges with the front wall and the rear wall, a block base, and a longitudinal seam, said block base formed by folding parts of the bottoms of the front wall, the rear wall and the sidewalls to form an overlapping arrangement, said plastic film consisting of a liquid and vapor-tight plastic composite film consisting of a high density polyethylene film and a low density polyethylene film, said composite film having a thickness of at least about 50 μm to about 300 μm, said plastic film of said bag being adhesively bonded at said longitudinal seam and said overlapping arrangement of said block base.

2. A block-base bag as defined in claim 1, wherein said block base includes a plastic film covering adhesively bonded to the bottom side of the block base.

3. A block-base bag as defined in claim 2, wherein said adhesive bonding of said overlapping arrangement of said block base includes two parallel beads of adhesive extending substantially the complete length of each overlapping section of said overlapping arrangement.

4. A block-base bag as defined in claim 3, wherein said adhesive is a hot-melt adhesive.

5. A block-base bag as defined in claim 1, wherein said adhesive bonding of said overlapping arrangement of said block base includes two parallel beads of adhesive extending substantially the complete length of each overlapping section of said overlapping arrangement.

6. A block-base bag as defined in claim 1, wherein said adhesive is a hot-melt adhesive.

7. A block-base bag consisting of plastic film and an adhesive for packing moisture-sensitive materials, said bag having a front wall, a rear wall, sidewalls which form longitudinal outer edges with the front wall and the rear wall, a block base, and a longitudinal seam, said block base formed by folding parts of the bottoms of the front wall, the rear wall and the sidewalls, each of which creates an overlapping section thereby forming an overlapping arrangement, said plastic film consisting of a liquid and vapor-tight plastic composite film comprising a polyethylene film, said composite film having a thickness of at least about 50 μm to about 300 μm, said plastic film of said block base being adhesively bonded together at said longitudinal seam, said adhesive bonding of said overlapping arrangement of said block-base including two parallel beads of adhesive extending substantially the complete length of each overlapping section of said overlapping arrangement.

8. A block-base bag as defined in claim 7, wherein said plastic film is a high density polyethylene film having a thickness of about 100 μm.

9. A block-base bag as defined in claim 8, wherein said block base includes a plastic film covering adhesively bonded to the bottom side of the block base.

10. A block-base bag as defined in claim 9, wherein said adhesive is a hot-melt adhesive.

11. A block-base bag as defined in claim 7, wherein said plastic film includes a high density polyethylene film and a low density polyethylene film.

12. A block-base bag as defined in claim 11, wherein said block base includes a plastic film covering adhesively bonded to the bottom side of the block base.

13. A block-base bag as defined in claim 12, wherein said adhesive is a hot-melt adhesive.

14. A block-base bag as defined in claim 7, wherein said block base includes a plastic film covering adhesively bonded to the bottom side of the block base.

15. A block-base bag as defined in claim 7, wherein said adhesive is a hot-melt adhesive.

* * * * *